US010203629B2

(12) United States Patent
Makita et al.

(10) Patent No.: US 10,203,629 B2
(45) Date of Patent: Feb. 12, 2019

(54) DEVELOPING ROLLER SUPPORT DEVICE INCLUDING A VISCOELASTIC BODY FOR REGULATING A DISTANCE BETWEEN IMAGE CARRIER AND DEVELOPING ROLLER

(71) Applicant: FUJI XEROX CO., LTD., Tokyo (JP)

(72) Inventors: Shota Makita, Kanagawa (JP); Shinichi Oba, Kanagawa (JP); Mutsumi Kikuchi, Kanagawa (JP); Nao Kato, Kanagawa (JP); Iori Togu, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/440,189

(22) Filed: Feb. 23, 2017

(65) Prior Publication Data

US 2018/0088488 A1 Mar. 29, 2018

(30) Foreign Application Priority Data

Sep. 28, 2016 (JP) ..... 2016-189096

(51) Int. Cl.

| | |
|---|---|
| ***G03G 15/01*** | (2006.01) |
| ***G03G 15/08*** | (2006.01) |
| ***G03G 21/16*** | (2006.01) |
| ***G03G 21/18*** | (2006.01) |

(52) U.S. Cl.

CPC ..... *G03G 15/0812* (2013.01); *G03G 15/08* (2013.01); *G03G 15/0808* (2013.01); *G03G 15/0813* (2013.01); *G03G 15/0121* (2013.01); *G03G 15/0818* (2013.01); *G03G 21/1619* (2013.01); *G03G 21/1676* (2013.01); *G03G 21/1821* (2013.01); *G03G 21/1864* (2013.01)

(58) Field of Classification Search

CPC ..... G03G 15/0121; G03G 15/0808; G03G 15/0812; G03G 15/0813; G03G 15/0818; G03G 21/1619; G03G 21/1676; G03G 21/1821; G03G 21/1864

See application file for complete search history.

(56) References Cited

U.S. PATENT DOCUMENTS

2001/0026707 A1* 10/2001 Miyabe ..... G03G 15/09 399/111
2012/0101213 A1* 4/2012 Tajiri ..... C08G 73/1039 524/538

FOREIGN PATENT DOCUMENTS

JP 2005-49499 A 2/2005
JP 2006-330676 A 12/2006

* cited by examiner

*Primary Examiner* — Joseph S Wong
(74) *Attorney, Agent, or Firm* — Sughrue Mion, PLLC

(57) ABSTRACT

Provided is an image forming apparatus including an image carrier on which a latent image is developed, a developing roller that is provided to face the image carrier to perform development for the latent image of the image carrier, an urging unit that urges the image carrier and the developing roller so that the image carrier and the developing roller approach each other, and a distance regulating unit that includes a viscoelastic body that is deformed according to a change of a distance between the image carrier and the developing roller, and regulates at least one of a maximum value of the distance between the image carrier and the developing roller and a minimum value of the distance between the image carrier and the developing roller so that the distance between the image carrier and the developing roller falls within a predetermined range.

19 Claims, 9 Drawing Sheets

DEVELOPING ROLLER SUPPORT DEVICE INCLUDING A VISCOELASTIC BODY FOR REGULATING A DISTANCE BETWEEN IMAGE CARRIER AND DEVELOPING ROLLER

CROSS-REFERENCE TO RELATED APPLICATIONS

This application is based on and claims priority under 35 USC 119 from Japanese Patent Application No. 2016-189096 filed Sep. 28, 2016.

BACKGROUND

Technical Field

The present invention relates to an image forming apparatus, a developing device, and a developing roller support device.

SUMMARY

According to an aspect of the invention, there is provided an image forming apparatus including:

an image carrier on which a latent image is developed;

a developing roller that is provided to face the image carrier to perform development for the latent image of the image carrier;

an urging unit that urges the image carrier and the developing roller so that the image carrier and the developing roller approach each other; and a distance regulating unit that includes a viscoelastic body that is deformed according to a change of a distance between the image carrier and the developing roller, and regulates at least one of a maximum value of the distance between the image carrier and the developing roller and a minimum value of the distance between the image carrier and the developing roller so that the distance between the image carrier and the developing roller falls within a predetermined range, wherein the distance regulating unit includes:

a bearing that rotatably supports the developing roller; and a bearing support portion that supports the bearing so that the bearing is movable in a direction in which the distance between the image holding member and the developing roller is changed, and wherein the viscoelastic body is provided to be interposed between the bearing and the bearing support portion.

BRIEF DESCRIPTION OF THE DRAWINGS

Exemplary embodiments of the present invention will be described in detail based on the following figures, wherein:

FIGS. 4A and 4B are views for describing an operation of a distance regulating mechanism used in the first exemplary embodiment of the present invention, in which FIG. 4A is a view illustrating the distance regulating mechanism when a distance between an image carrier and a developing roller is minimized, and FIG. 4B is a view illustrating the distance regulating mechanism when a distance between the image carrier and the developing roller is maximized;

FIGS. 8A and 8B are views for describing an operation of a distance regulating mechanism used in the second exemplary embodiment of the present invention, in which FIG. 8A is a view illustrating the distance regulating mechanism when a distance between an image carrier and a developing roller is minimized, and FIG. 8B is a view illustrating the distance regulating mechanism when a distance between the image carrier and the developing roller is maximized;

DETAILED DESCRIPTION

Hereinafter, an exemplary embodiment of the present invention will be described in detail with reference to the accompanying drawings.

Figure 1:
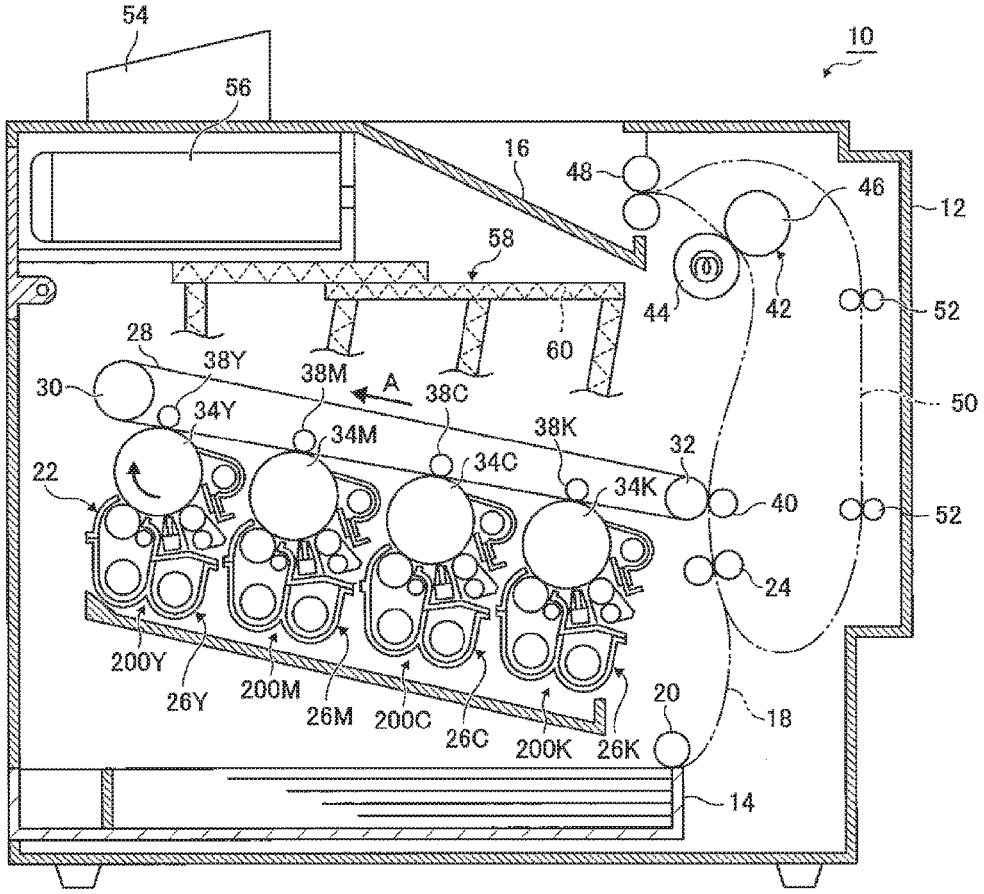
FIG. 1 is a sectional view illustrating an image forming apparatus according to a first exemplary embodiment of the present invention, when viewed from the front side.

FIG. 1 is a view illustrating a configuration of an image forming apparatus 10 according to a first exemplary embodiment of the present invention.

The image forming apparatus 10 includes an image forming apparatus body 12. A sheet accommodating unit 14 is provided at a lower portion of the image forming apparatus body 12, and a sheet discharge unit 16 is provided at an upper portion of the image forming apparatus body 12. Plural sheets are accommodated in the sheet accommodating unit 14. A sheet path 18 is formed extending from the sheet accommodating unit 14 to the sheet discharge unit 16.

The sheet placed at the uppermost position of the sheet accommodating unit 14 is fed by a pickup roller 20. The fed sheet is temporarily stopped by registration rollers 24 to be positioned and regulated, and is transported toward a secondary transfer roller 40 to be described later at a predetermined timing.

An image forming unit 22 is provided at the center portion of the image forming apparatus body 12. The image forming unit 22 includes, for example, four image forming units 26Y, 26M, 26C, and 26K. The image forming units 26Y, 26M, 26C, and 26K are provided to correspond to respective colors of yellow (Y), magenta (M), cyan (C), and black (K), and are arranged along an intermediate transfer belt 28 at equal intervals. The intermediate transfer belt 28 is supported by, for example, two support rollers 30 and 32, and rotates in the direction of the arrow A.

The image forming units 26Y, 26M, 26C, and 26K include photoconductor drums 34Y, 34M, 34C, and 34K each of which is an image carrier, and developing devices 200Y, 200M, 200C, and 200K, respectively. The photoconductor drums 34Y, 34M, 34C, and 34K face primary transfer rollers 38Y, 38M, 38C, and 38K across the intermediate transfer belt 28, and developer images formed by the primary transfer rollers 38Y, 38M, 38C, and 38K in the image forming units 26Y, 26M, 26C, and 26K are primarily transferred to the intermediate transfer belt 28.

The secondary transfer roller 40 faces the support roller 32 across the intermediate transfer belt 28. By the secondary transfer roller 40, the primarily transferred developer image is secondarily transferred to the sheet transported through the sheet path 18.

The sheet to which the developer image is secondarily transferred is transported to a fixing device 42. The fixing device 42 is a device that fixes a toner image transferred to the sheet, on the sheet by, for example, heat and pressure, and includes, for example, a heating roller 44 and a pressure roller 46. The sheet on which the developer image is fixed by the fixing device 42 is discharged to the sheet discharge unit 16 by discharge rollers 48.

The image forming apparatus 10 further includes a reverse transport path 50. The reverse transport path 50 is a transport path that reverses a sheet having the developer image formed on one surface thereof, and transports the sheet to the upstream side of the registration rollers 24 in the sheet path 18. For example, two transport rollers 52 are disposed along the reverse transport path 50, and the sheet fed to the reverse transport path 50 from the discharge rollers 48 is transported to the sheet path 18 by the transport rollers 52.

The image forming apparatus 10 further includes a UI device 54. The UI device 54 is provided, for example, on the top of the image forming apparatus body 12. The UI device 54 is configured by combining, for example, a liquid display device and a touch panel-type information input device, and allows an operator to input setting information for image formation or displays information to the operator.

The image forming apparatus 10 further includes developer containers 56 corresponding to the number of the developing devices 200Y, 200M, 200C, and 200K. A developer (toner) is contained in each of the developer containers 56. The developer containers 56 are detachably mounted to the image forming apparatus body 12, for example, in the upper portion of the image forming apparatus body 12.

The image forming apparatus 10 further includes a developer transport device 58. The developer transport device 58 transports developers of respective colors contained in the developer containers 56 to the corresponding developing devices 200Y, 200M, 200C, and 200K. A transport member 60 formed in a spiral shape is provided in the developer transport device 58. When the transport member 60 is rotated, the developers are transported from the developer containers 56 to the developing devices 200Y, 200M, 200C, 200K, respectively.

Figure 2:
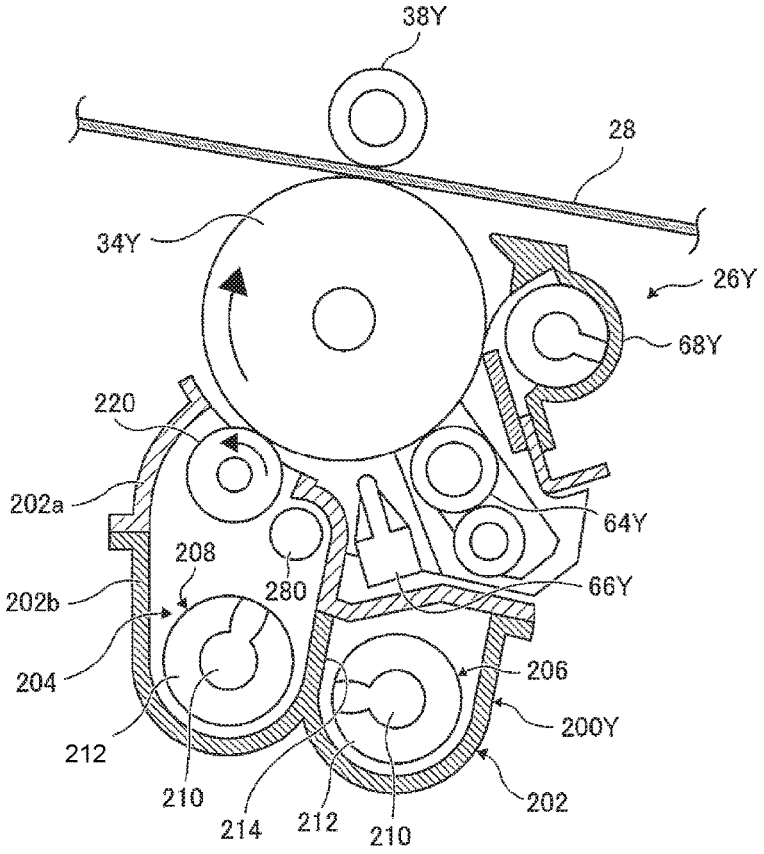
FIG. 2 is a sectional view illustrating an image forming unit used in the first exemplary embodiment of the present invention, when viewed from the front side.

In FIG. 2, the image forming unit 26Y for yellow is illustrated as an example of the image forming unit 26. Meanwhile, configurations of other image forming units 26M, 26C, and 26K are the same as that of the image forming unit 26Y for yellow, and thus descriptions thereof will be omitted.

The image forming unit 26Y includes, in addition to the photoconductor drum 34Y and the developing device 200Y as described above, a charging device 64Y that charges the photoconductor drum 34Y, a latent image forming device 66Y that irradiates the surface of the photoconductor drum 34Y charged by the charging device 64Y with light to form a latent image on the surface of the photoconductor drum 34Y, and a cleaning device 68Y that cleans the photoconductor drum 34Y by removing a toner, or the like remaining on the photoconductor drum 34Y after a toner image is transferred to the intermediate transfer belt 28 by the primary transfer roller 38Y.

The developing device 200Y is a two-component developing device that uses a toner and a carrier for development. The developing device 200Y includes a developing device side casing 202. The developing device side casing 202 is formed by joining an upper member 202*a* to a lower member 202*b*. A developer circulation path 204 is formed at the lower portion of the developing device side casing 202. A first developer transport member 206 and a second developer transport member 208 are disposed in the developer circulation path 204. Each of the first developer transport member 206 and the second developer transport member 208 includes a rotating shaft 210, and a spiral agitation transport unit 212 formed around the rotating shaft 210. The first developer transport member 206 and the second developer transport member 208 are spaced apart from each other by a partition wall portion 214 formed in a central longitudinal direction. Openings (not illustrated) are formed at both sides in the longitudinal direction of the partition wall portion 214. Through the openings, a developer is circulated in the developer circulation path 204.

A developer supply port (not illustrated) is formed at the developing device side casing 202 to be connected to the developer circulation path 204. From the developer supply port, a new toner is supplied through the developer transport device 58 from the developer container 56 as described above.

The developing device 200Y includes a developing roller 220. The developing roller 220 is provided to face the photoconductor drum 34Y to develop the latent image on the photoconductor drum 34Y. A layer thickness regulating member 280 is provided at the upstream side of a developing area facing the photoconductor drum 34Y. The layer thickness regulating member 280 regulates a layer thickness of a magnetic brush formed on the developing roller 220. Then, the developer with a layer thickness regulated by the layer thickness regulating member 280 is supplied to the developing area to form a toner image on the photoconductor drum 34Y.

Figure 3:
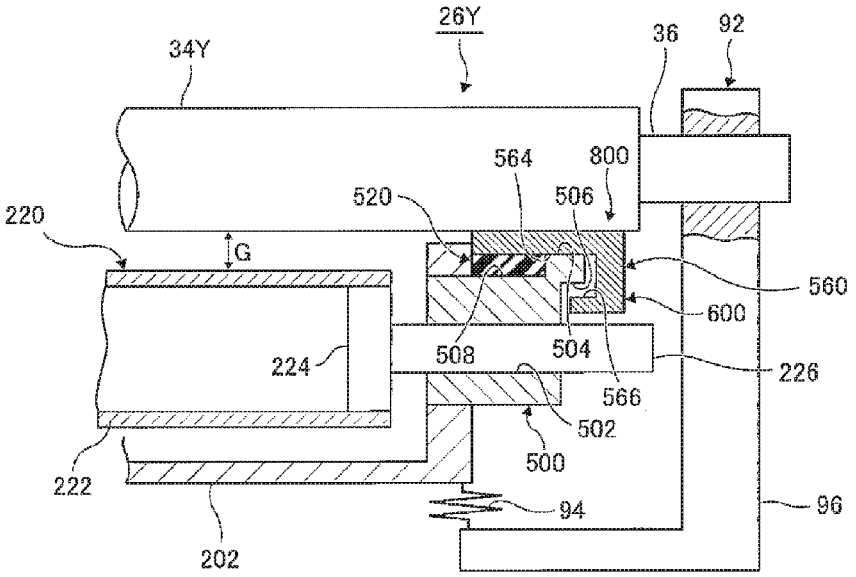
FIG. 3 is a sectional view schematically illustrating a front portion of the image forming unit used in the first exemplary embodiment of the present invention, when viewed from the left side.

FIG. 3 is a sectional view schematically illustrating a front portion of the image forming unit 26Y, when viewed from the left side. The image forming unit 26Y is symmetrical in the front-rear direction (the left-right direction in FIG. 3, and the direction intersecting with the sheet surface in FIGS. 1 and 2). The rear-side configuration of the image forming unit 26Y is the same as the front-side configuration of the image forming unit 26Y, and thus descriptions thereof will be omitted.

As illustrated in FIG. 3, the photoconductor drum 34Y includes a drum rotating shaft 36, and is rotatably supported by a side plate 96 of a photoconductor drum side casing 92 through the drum rotating shaft 36. Here, the photoconductor drum side casing 92 and the above described developing device side casing 202 (see, e.g., FIG. 2) may approach each other or may be separated from each other by, for example, a configuration such as connection through a hinge (not illustrated), or the like.

The above described developing roller 220 includes a cylindrical member 222 serving as a developer holding portion, and a flange member 224 mounted at the front side of the cylindrical member 222. An outer side (the right end portion side) of the flange member 224 is used as a roll rotating shaft 226, and the roll rotating shaft 226 is rotatably attached to the developing device side casing 202 through a bearing 500. The cylindrical member 222 holds the developer on the outer circumferential surface thereof.

The bearing 500 has a sliding surface 502 that rotatably supports the developing roller 220. The bearing 500 has a mounting surface 508 on which a viscoelastic body 520 to be described below is mounted (provided) by, for example, a bonding method or the like. The bearing 500 has a first contact surface 504 that is a surface at the photoconductor drum 34Y side and comes in contact with a bearing support member 560 to be described below. The bearing 500 has a second contact surface 506 that is a surface located at the opposite side to the photoconductor drum 34Y, and comes in contact with the bearing support member 560 to be described below.

A step is formed between the mounting surface 508 and the first contact surface 504. More specifically, the mounting surface 508 and the first contact surface 504 are parallel to each other and parallel to the rotation axis of the photoconductor drum 34Y. The first contact surface 504 is disposed at a position closer to a first contacted surface 564 to be described below than the mounting surface 508.

The image forming unit 26Y further includes the bearing support member 560 used as a bearing support portion. The bearing support member 560 supports the bearing 500 so that the bearing 500 is movable in a direction in which a distance G between the photoconductor drum 34Y and the developing roller 220 (hereinafter, referred to as a DRS) is changed. The bearing support member 560 is fixed with respect to, for example, the photoconductor drum side casing 92.

The bearing support member 560 has the first contacted surface 564 with which the first contact surface 504 comes in contact. The bearing support member 560 has a second contacted surface 566 with which the second contact surface 506 comes in contact.

The image forming unit 26Y further includes the viscoelastic body 520. The viscoelastic body 520 is mounted to be interposed between the bearing 500 and the bearing support member 560. The viscoelastic body 520 is deformed according to the change of a distance between the photoconductor drum 34Y and the developing roller 220. As a specific material of the viscoelastic body 520, for example, a thermoplastic elastomer such as a styrene-based, olefin-based, vinyl chloride-based, urethane-based, or amide-based material may be used, and the viscoelastic body 520 may be made of a material containing any one of polyimide, polyethylene terephthalate, polyoxymethylene resin, and polyacetal resin.

The image forming unit 26Y further includes a coil spring 94 used as an urging unit. One end portion of the coil spring 94 is mounted on the photoconductor drum side casing 92, and the other end is mounted on the developing device side casing 202 such that the coil spring 94 urges the developing device side casing 202 to the photoconductor drum 34Y side. That is, the coil spring 94 urges the developing device side casing 202 such that the photoconductor drum 34Y and the developing roller 220 approach each other.

The above described bearing 500, the bearing support member 560, and the viscoelastic body 520 configure, for example, a developing roller support device 600 that supports the developing roller 220. The developing roller support device 600 is configured as a single unit, and may be integrally mounted to or detached from the image forming unit 26Y.

In the developing roller support device 600, when one of the bearing 500 and the bearing support member 560 is fixed and the other of the bearing 500 and the bearing support member 560 is moved, the viscoelastic body 520 is elastically deformed, so that a positional relationship between the bearing 500 and the bearing support member 560 is changed.

In the image forming unit 26Y configured as described above, due to urge by the coil spring 94, the viscoelastic body 520 is deformed while being pressed and crushed by the bearing support member 560 and the bearing 500. Then, the own weight applied to the developing roller 220, the bearing 500, and the developing device side casing 202, and the repulsive force of the viscoelastic body 520 caused by deformation of the viscoelastic body 520 are balanced with the pressing force of the coil spring 94. Here, the viscoelastic body 520 is changed according to the DRS.

In the image forming unit 26Y configured as described above, a change of the DRS is absorbed by the deformation of the viscoelastic body 520, and thus a development unevenness caused by the DRS change is suppressed.

Meanwhile, since the image forming unit 26Y has the viscoelastic body 520, when the viscoelastic body 520 is deteriorated, or is excessively deformed, the DRS may be largely changed, and at least one of a maximum value and a minimum value of the DRS may not fall within a range required for suppressing the density unevenness. Thus, the image forming unit 26Y includes a distance regulating mechanism 800 that regulates the maximum value and the minimum value of the DRS so that the DRS may fall within a predetermined range. Here, the distance regulating mechanism 800 is an example of a distance regulating unit.

The distance regulating mechanism 800 includes the above described bearing 500, the above described bearing support member 560, and the viscoelastic body 520. The distance regulating mechanism 800 to be described below regulates both the maximum value and the minimum value of the DRS. However, the distance regulating mechanism 800 may regulate at least one of the maximum value and the minimum value of the DRS.

Figure 4A:
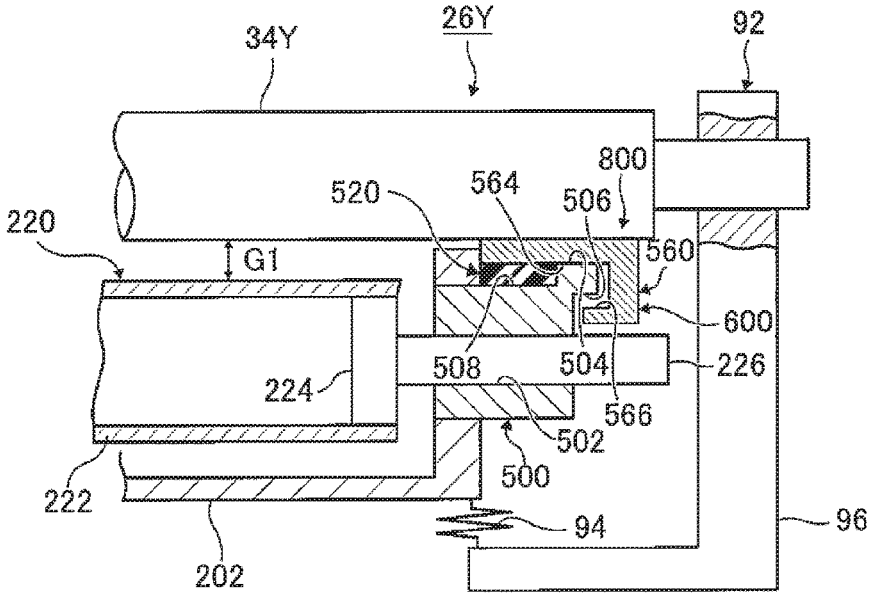
Figure 4B:
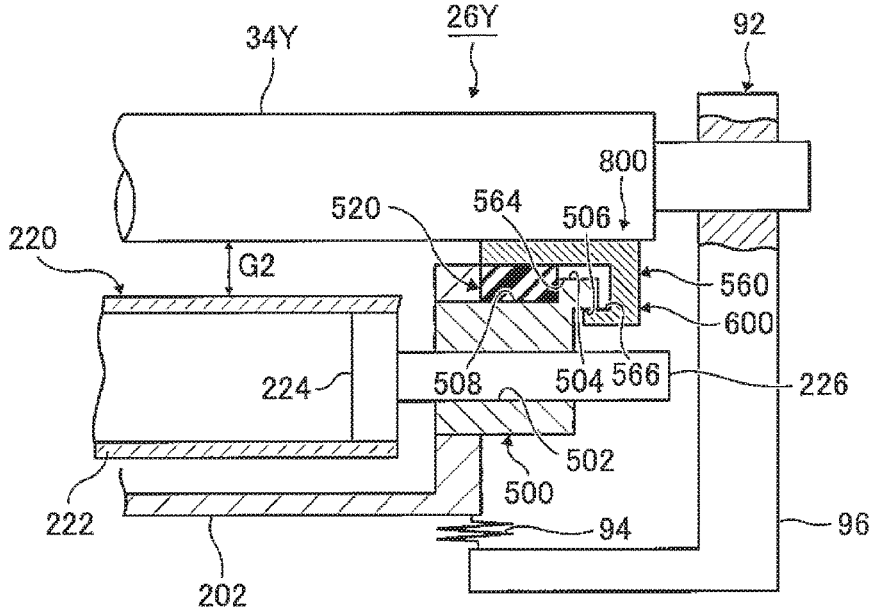

FIGS. 4A and 4B are views for describing an operation of the distance regulating mechanism 800, in which FIG. 4A illustrates the distance regulating mechanism 800 when the DRS is minimized, and FIG. 4B illustrates the distance regulating mechanism 800 when the DRS is maximized.

As illustrated in FIG. 4A, in a state where the viscoelastic body 520 is contracted, the distance regulating mechanism 800 brings the first contact surface 504 of the bearing 500, which is a surface at the photoconductor drum 34Y side and is different from the mounting surface 508 on which the viscoelastic body 520 is provided, into contact with the first contacted surface 564 of the bearing support member 560 to regulate the minimum value of the DRS. Here, G1 in FIG. 4A indicates the minimum value of the DRS.

As illustrated in FIG. 4B, the distance regulating mechanism 800 brings the second contact surface 506 of the bearing 500, which is a surface located at the opposite side to the photoconductor drum 34Y, into contact with the second contacted surface 566 of the bearing support member 560 to regulate the maximum value of the DRS. Here, G2 in FIG. 4B indicates the maximum value of the DRS.

Figure 5:
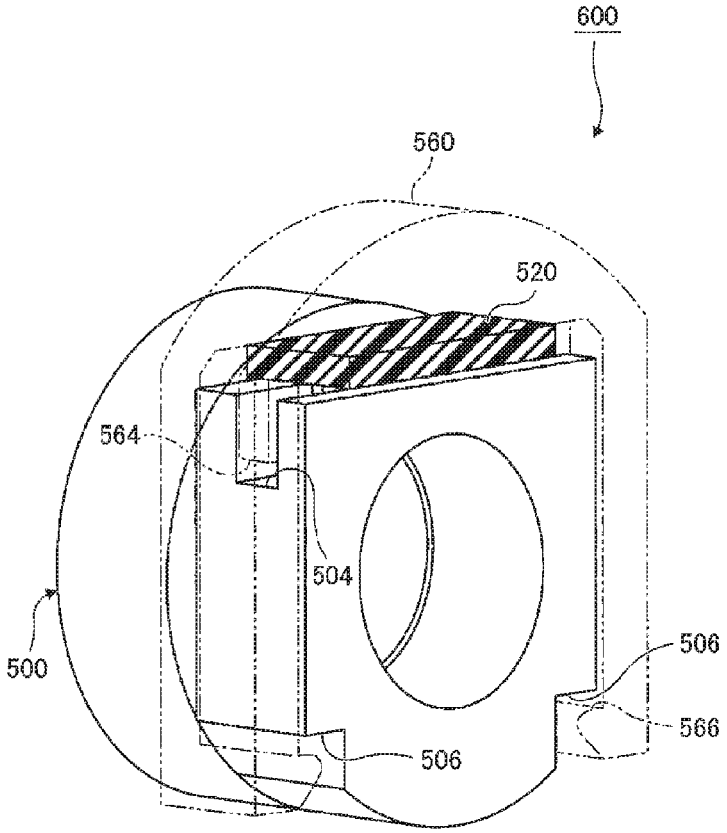
FIG. 5 is a perspective view illustrating a modified example of a bearing and a bearing support member used in the first exemplary embodiment of the present invention.
Figure 6:
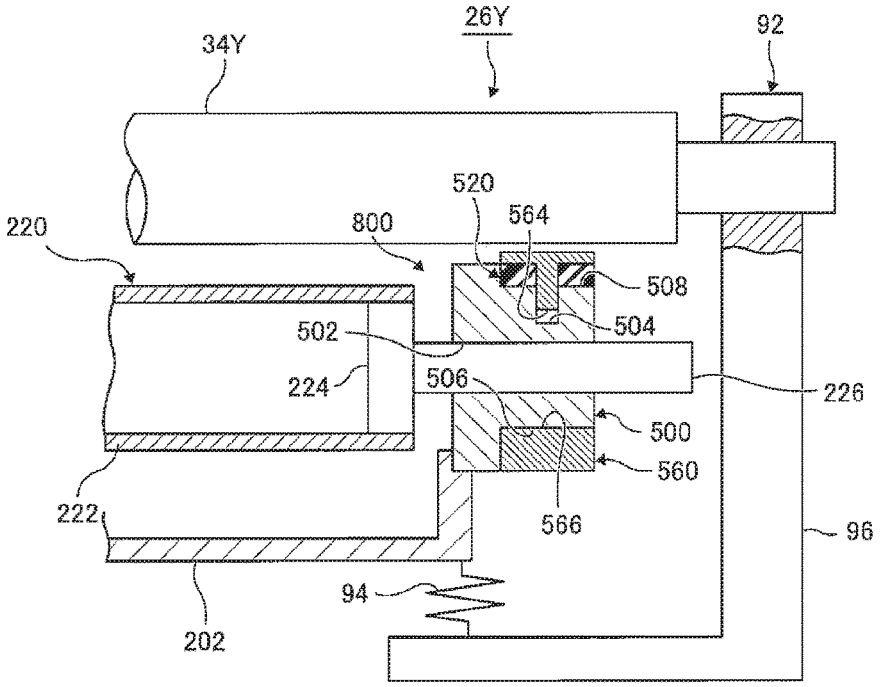
FIG. 6 is a sectional view schematically illustrating a front portion of a modified example of the image forming unit used in the first exemplary embodiment of the present invention, when viewed from the left side.

FIGS. 5 and 6 are views illustrating a modified example of the developing roller support device 600 used in the first exemplary embodiment. In this modified example as well, like the developing roller support device 600 used in the first exemplary embodiment, the distance regulating mechanism 800, in a state where the viscoelastic body 520 is contracted, brings the first contact surface 504 of the bearing 500, which is a surface at the photoconductor drum 34Y side and is different from the mounting surface 508 on which the viscoelastic body 520 is provided, into contact with the first contacted surface 564 of the bearing support member 560 to regulate the minimum value of the DRS.

In this modified example as well, like the developing roller support device 600 used in the first exemplary embodiment, the distance regulating mechanism 800 brings the second contact surface 506 of the bearing 500, which is a surface located at the opposite side to the photoconductor drum 34Y, into contact with the second contacted surface 566 of the bearing support member 560 to regulate the maximum value of the DRS.

As described above, this modified example has technical features in common with the developing roller support device 600 used in the first exemplary embodiment, but is different from the developing roller support device 600 used in the first exemplary embodiment in terms of the shape of the bearing support member 560. The bearing support member 560 supports the bearing 500 from the side surface so that the bearing 500 is slidable.

This modified example is different from the developing roller support device 600 used in the first exemplary embodiment in terms of the shape of the bearing 500, and also positions where the first contact surface 504, the second contact surface 506, the first contacted surface 564, and the second contacted surface 566 are formed, respectively. With respect to portions other than those as described above, this modified example is the same as the above described first exemplary embodiment, and thus descriptions on the same portions will be omitted.

Figure 7:
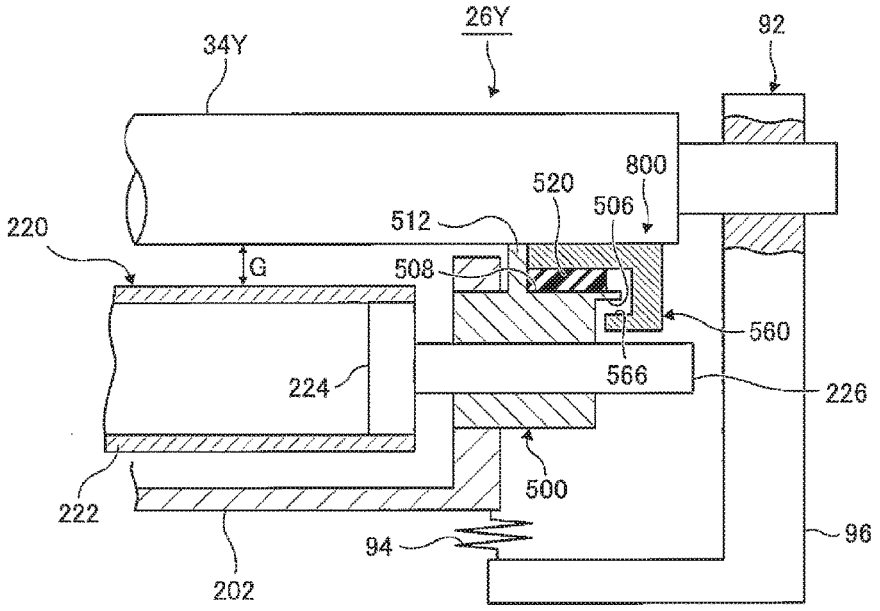
FIG. 7 is a sectional view schematically illustrating a front portion of an image forming unit used in a second exemplary embodiment of the present invention, when viewed from the left side.

FIG. 7 is a sectional view schematically illustrating a front portion of the image forming unit 26Y used in the image forming apparatus 10 according to a second exemplary embodiment of the present invention, when viewed from the left side.

In the second exemplary embodiment as well, as in the first exemplary embodiment, the distance regulating mechanism 800 brings the second contact surface 506 of the bearing 500, which is a surface located at the opposite side to the photoconductor drum 34Y, into contact with the second contacted surface 566 of the bearing support member 560 to regulate the maximum value of the DRS.

In the first exemplary embodiment, the distance regulating mechanism 800 brings the first contact surface 504 of the bearing 500, which is a surface at the photoconductor drum 34Y side, into contact with the bearing support member 560 to regulate the minimum value of the DRS (see, e.g., FIG. 4A). Meanwhile, in the second exemplary embodiment, the bearing 500 includes a protruding portion 512 protruding toward the photoconductor drum 34Y, and brings the protruding portion 512 into contact with the photoconductor drum 34Y to regulate the minimum value of the DRS.

Figure 8A:
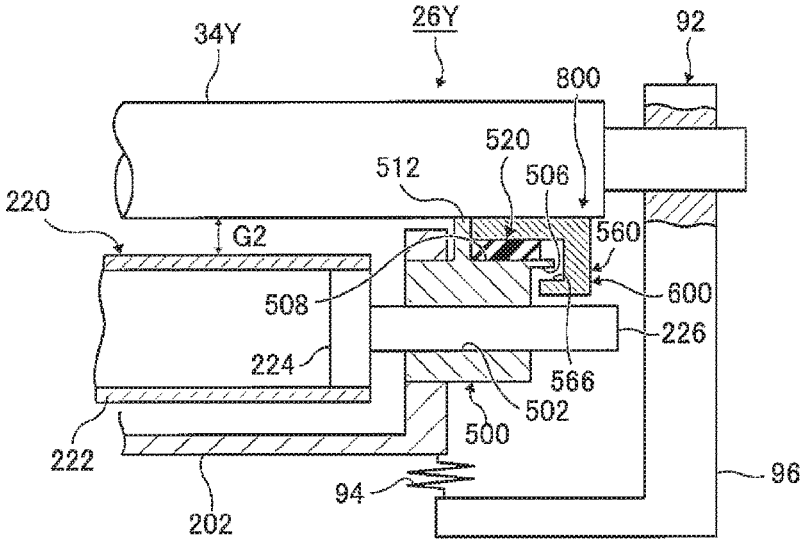
Figure 8B:
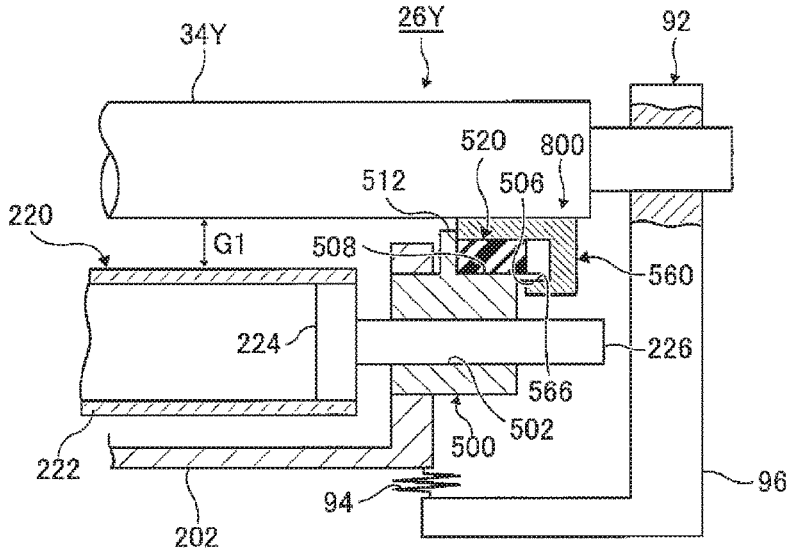

FIGS. 8A and 8B are views for describing an operation of the distance regulating mechanism 800 used in the second exemplary embodiment. FIG. 8A is a view illustrating a state where the distance regulating mechanism 800 brings the protruding portion 512 into contact with the photoconductor drum 34Y to regulate the minimum value of the DRS. FIG. 8B is a view illustrating a state where the distance regulating mechanism 800 brings the second contact surface 506 of the bearing 500, which is a surface located at the opposite side to the photoconductor drum 34Y, into contact with the bearing support member 560 to regulate the maximum value of the DRS.

Figure 9:
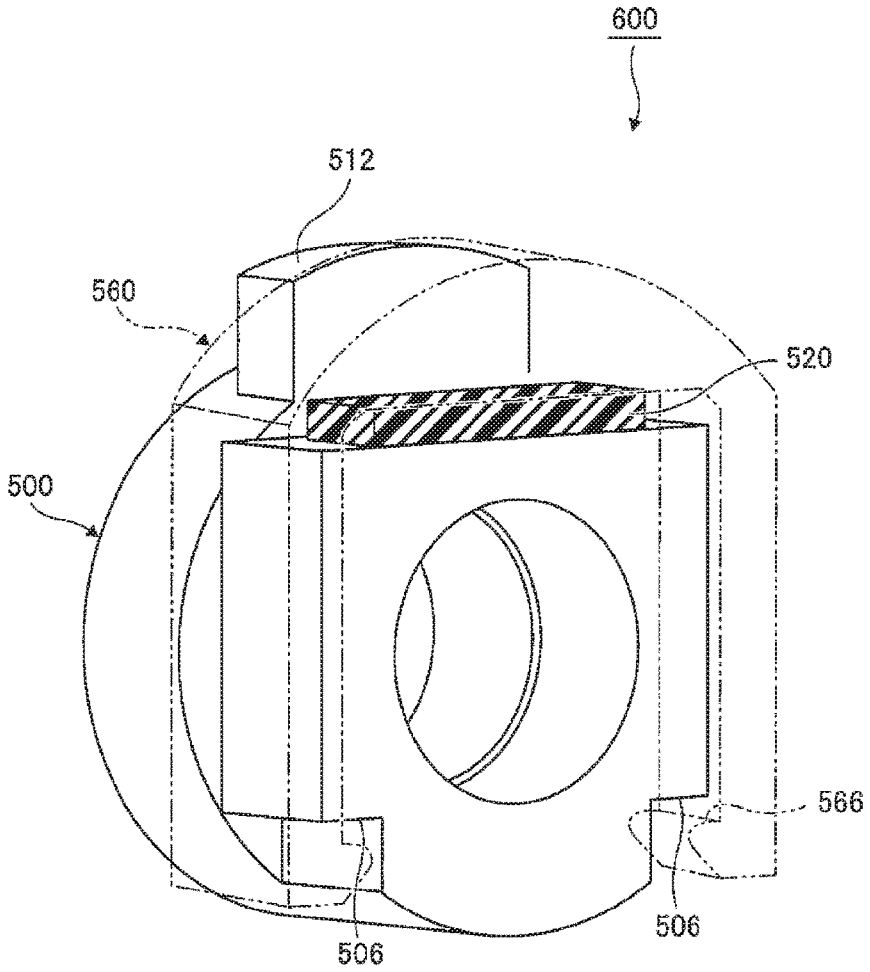
FIG. 9 is a perspective view illustrating a modified example of a bearing and a bearing support member used in the second exemplary embodiment of the present invention.
Figure 10:
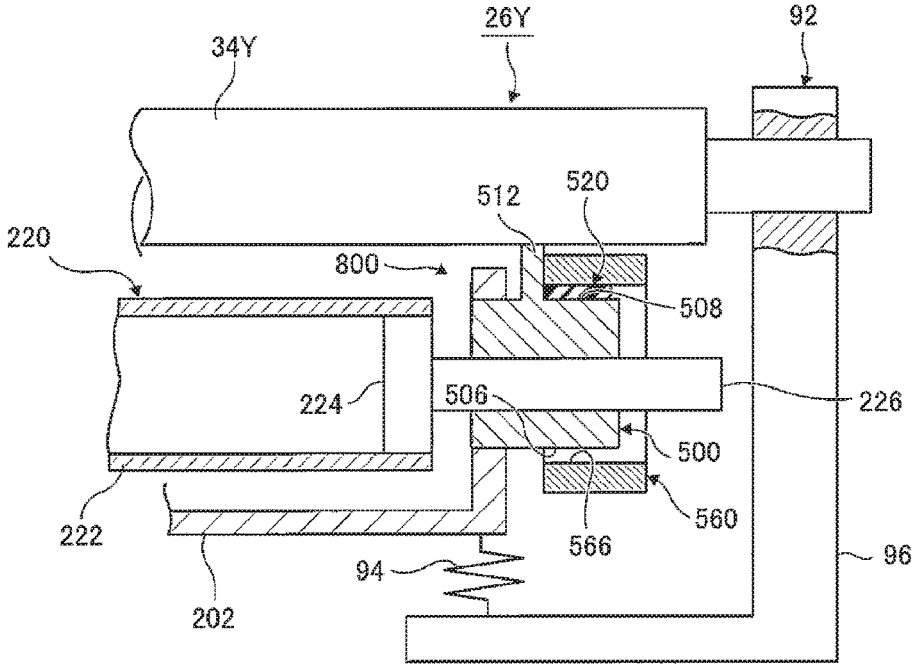
FIG. 10 is a sectional view schematically illustrating a front portion of a modified example of the image forming unit used in the second exemplary embodiment of the present invention, when viewed from the left side.

FIGS. 9 and 10 are views illustrating a modified example of the developing roller support device 600 used in the second exemplary embodiment. In this modified example as well, like the developing roller support device 600 used in the second exemplary embodiment, the distance regulating mechanism 800 brings the protruding portion 512 into contact with the photoconductor drum 34Y in a state where the viscoelastic body 520 is contracted to regulate the minimum value of the DRS.

In this modified example as well, like the developing roller support device 600 used in the second exemplary embodiment, the distance regulating mechanism 800 brings the second contact surface 506 of the bearing 500, which is a surface located at the opposite side to the photoconductor drum 34Y, into contact with the second contacted surface 566 of the bearing support member 560 to regulate the maximum value of the DRS.

As described above, this modified example has technical features in common with the developing roller support device 600 used in the second exemplary embodiment, but is different from the developing roller support device 600 used in the second exemplary embodiment in terms of the shape of the bearing support member 560. The bearing support member 560 supports the bearing 500 from the side surface so that the bearing 500 is slidable.

This modified example is different from the developing roller support device 600 used in the second exemplary embodiment in terms of the shape of the bearing 500, and also positions where the second contact surface 506 and the second contacted surface 566 are formed, respectively. With respect to portions other than those as described above, this modified example is the same as the above described second exemplary embodiment, and thus descriptions on the same portions will be omitted.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier;

a developing roller that is provided to face the image carrier and is configured to perform development for a latent image of the image carrier;

an urging unit configured to urge the image carrier and the developing roller so that the image carrier and the developing roller approach each other;

a distance regulating unit that includes a viscoelastic body configured to deform according to a change of a distance between the image carrier and the developing roller, wherein the distance regulating unit is configured to regulate at least one of a maximum value of the distance between the image carrier and the developing roller and a minimum value of the distance between the image carrier and the developing roller so that the distance between the image carrier and the developing roller falls within a predetermined range, wherein the distance regulating unit includes:

a bearing that rotatably supports the developing roller; and a bearing support portion that supports the bearing so that the bearing is movable in a direction in which the distance between the image carrier and the developing roller is changed, wherein the viscoelastic body is interposed between the bearing and the bearing support portion, and wherein the viscoelastic body contacts the bearing support portion.

2. The image forming apparatus according to claim 1, wherein the distance regulating unit brings a surface of the bearing, which is located at the image carrier side and is different from a surface on which the viscoelastic body is provided, into contact with the bearing support portion in a state where the viscoelastic body is contracted, to regulate the minimum value of the distance between the image carrier and the developing roller.

3. The image forming apparatus according to claim 1, wherein the distance regulating unit is configured to bring the bearing into contact with the image carrier to regulate the minimum value of the distance between the image carrier and the developing roller.

4. The image forming apparatus according to claim 1, wherein the distance regulating unit is configured to bring a surface of the bearing, which is located at an opposite side to the image carrier, into contact with the bearing support portion to regulate the maximum value of the distance between the image carrier and the developing roller.

5. The image forming apparatus according to claim 2, wherein the distance regulating unit is configured to bring a surface of the bearing, which is located at an opposite side to the image carrier, into contact with the bearing support portion to regulate the maximum value of the distance between the image carrier and the developing roller.

6. The image forming apparatus according to claim 1, wherein the viscoelastic body is made of a material containing any one of polyimide, polyethylene terephthalate, polyoxymethylene resin, and polyacetal resin.

7. The image forming apparatus according to claim 2, wherein the viscoelastic body is made of a material containing any one of polyimide, polyethylene terephthalate, polyoxymethylene resin, and polyacetal resin.

8. The image forming apparatus according to claim 3, wherein the viscoelastic body is made of a material containing any one of polyimide, polyethylene terephthalate, polyoxymethylene resin, and polyacetal resin.

9. The image forming apparatus according to claim 4, wherein the viscoelastic body is made of a material containing any one of polyimide, polyethylene terephthalate, polyoxymethylene resin, and polyacetal resin.

10. The image forming apparatus according to claim 5, wherein the viscoelastic body is made of a material containing any one of polyimide, polyethylene terephthalate, polyoxymethylene resin, and polyacetal resin.

11. A developing device comprising:

a developing roller that is provided to face an image carrier on which a latent image is developed and is configured to perform development for the latent image of the image carrier;

an urging unit configured to urge the image carrier and the developing roller so that the image carrier and the developing roller approach each other; and a distance regulating unit that includes a viscoelastic body that configured to deform according to a change of a distance between the image carrier and the developing roller, wherein the distance regulating unit is configured to regulate at least one of a maximum value of the distance between the image carrier and the developing roller and a minimum value of the distance between the image carrier and the developing roller so that the distance between the image carrier and the developing roller falls within a predetermined range, wherein the distance regulating unit includes:

a bearing that rotatably supports the developing roller; and a bearing support portion that supports the bearing so that the bearing is movable in a direction in which the distance between the image carrier and the developing roller is changed, wherein the viscoelastic body is interposed between the bearing and the bearing support portion, and wherein the viscoelastic body contacts the bearing support portion.

12. A developing roller support device for regulating at least one of a maximum value of a distance between an image carrier and a developing roller and a minimum value of the distance between the image carrier and the developing roller so that the distance between the image carrier and the developing roller falls within a predetermined range, wherein the developing roller support device comprises:

a bearing that rotatably supports the developing roller;

a bearing support portion that supports the bearing so that the bearing is movable in a direction in which the distance between the image carrier and the developing roller is changed; and a viscoelastic body that is interposed between the bearing and the bearing support member, wherein the viscoelastic body is configured to deform according to a change of the distance between the image carrier and the developing roller, wherein the viscoelastic body contacts the bearing support portion.

13. The image forming apparatus according to claim 1, wherein the viscoelastic body is mounted on a mounting surface of the bearing.

14. The image forming apparatus according to claim 1, wherein the viscoelastic body contacts the bearing.

15. The image forming apparatus according to claim 14, wherein the viscoelastic body contacts the bearing support portion.

16. The image forming apparatus according to claim 1, wherein the viscoelastic body overlaps with the bearing and the bearing support portion when viewed from a direction parallel to an axial direction of the developing roller.

17. The image forming apparatus according to claim 1, wherein the viscoelastic body overlaps with the bearing and the bearing support portion when viewed from a direction perpendicular to an axial direction of the developing roller.

18. The image forming apparatus according to claim 1, wherein the bearing support portion overlaps with the image carrier when viewed from a direction perpendicular to an axial direction of the developing roller.

19. The image forming apparatus according to claim 1, wherein the image forming apparatus is configured such that the viscoelastic body is positionally regulated by a first surface of the bearing and a second surface of the bearing, and wherein the second surface of the bearing is perpendicular to the first surface of the bearing.

* * * * *